US005940671A

United States Patent [19]

Kim

[11] Patent Number: 5,940,671

[45] Date of Patent: Aug. 17, 1999

[54] PRINTER WITH TRANSFER UNIT SUPPORT AND ADJUSTMENT

[75] Inventor: Yong-su Kim, Yongin, Rep. of Korea

[73] Assignee: Samsung Electronics Co., Ltd., Kyungki-do, Rep. of Korea

[21] Appl. No.: 09/057,514

[22] Filed: Apr. 9, 1998

[30] Foreign Application Priority Data

Aug. 30, 1997 [KR] Rep. of Korea ..... 97-44403

[51] Int. Cl.[6] ..... G03G 15/16

[52] U.S. Cl. ..... 399/318; 399/121; 399/308

[58] Field of Search ..... 399/302, 307, 399/308, 318, 319, 121, 339

[56] References Cited

U.S. PATENT DOCUMENTS

| | | | |
|---|---|---|---|
| 5,150,161 | 9/1992 | Bujese | 399/308 |
| 5,374,982 | 12/1994 | Boockkholdt | 399/318 |
| 5,420,676 | 5/1995 | Arcaro | 399/313 |
| 5,534,984 | 7/1996 | Inoue | 399/308 |
| 5,774,774 | 6/1998 | Tamura et al. | 399/302 |

FOREIGN PATENT DOCUMENTS

| | | |
|---|---|---|
| 58-105268 | 6/1983 | Japan . |
| 03-171072 | 7/1991 | Japan . |
| 09-062122 | 3/1997 | Japan . |

*Primary Examiner*—Matthew S. Smith
*Attorney, Agent, or Firm*—Sughrue, Mion, Zinn, Macpeak & Seas, PLLC

[57] ABSTRACT

A wet electrophotographic printer includes a plurality of electrostatic latent image forming units for forming an electrostatic latent image on a photosensitive belt on an endless track, a developer for fixing a developing solution on a portion of the belt where the electrostatic latent image is formed, a drier for drying the developing solution to form a toner image, a transfer unit for transferring the toner image to a recording sheet, and a carrier unit having a plurality of carrier rollers rotating the photosensitive belt. The transfer unit includes a transfer roller confronting a carrier roller with the photosensitive belt interposed therebetween, a pressing roller confronting the transfer roller with the recording sheet interposed therebetween, and elevating means for elevating the transfer roller and the pressing roller with respect to the transfer roller within a predetermined timing interval. Therefore, the respective contact widths and pressures between the carrier roller and the transfer roller and between the carrier roller and the pressing roller, can be maintained constantly.

18 Claims, 3 Drawing Sheets

PRINTER WITH TRANSFER UNIT SUPPORT AND ADJUSTMENT

BACKGROUND OF THE INVENTION

1. Field of the Invention

The present invention relates to a wet electrophotographic printer, and more particularly, to a wet electrophotographic printer with an improved transfer unit for transferring a toner image left on a photosensitive belt.

2. Description of the Related Art

In general, an electrophotographic printer such as a laser printer is an apparatus in which an electrostatic latent image is formed on a photosensitive medium such as a photosensitive drum or a photosensitive belt, and the electrostatic latent image is then developed by a toner having a predetermined color and transferred on a recording sheet to obtain a desired image. Laser printers are generally divided into the wet laser printer type and the dry laser printer type depending upon the kind of toner employed. The wet laser printer employs a developing solution mixed with a toner in a volatile liquid carrier. The wet laser printer employing such a developing solution is better with respect to printing performance than the dry laser printer employing a powdered toner. Moreover, since problems caused by powdered toner dust can be avoided, the wet laser printer is increasingly becoming the preferred type.

FIG. 1 is a schematic diagram showing important parts of a wet laser printer as a kind of a conventional wet electrophotographic printer.

Referring to FIG. 1, a general wet laser printer includes a photosensitive belt 110 having an endless track, a first carrier roller 121, a second carrier roller 122, and a third carrier roller 123 for rotatably moving the photosensitive belt 110 in a given path. Generally, the third carrier roller 123 is driven by a driving motor (not shown) to rotate the photosensitive belt 110. The second carrier roller 122 is a steering roller for adjusting a tensile force applied to the photosensitive belt 110 to prevent the meandering of the photosensitive belt.

Also, there is provided a main charger 135 installed on one side of the photosensitive belt 110 for uniformly charging the photosensitive belt 110. A plurality of electrostatic latent units (laser scanning units) 130 are formed in the lower portion of the photosensitive belt 110 for scanning a laser beam onto the photosensitive belt 110 according to an image signal and forming an electrostatic latent image thereon. A developer 140 is installed for developing the electrostatic latent image such that a developing solution composed of a toner having a predetermined color and a liquid carrier adheres to a portion of the belt where the electrostatic latent image is formed. In the case of a color printer, there are provided a plurality of electrostatic latent image forming units 130 for color combination and a developer containing a plurality of kinds of developing solution each having a predetermined color.

The developing solution adhering to the photosensitive belt 110 by the developer 140 is dried by a drier 150 provided along the path of the photosensitive belt 110 after the developer 140 so that the liquid carrier is eliminated, thereby forming a toner image with only the toner from the electrostatic latent image of the photosensitive belt 110.

The toner image is transferred to a recording sheet 126 by a transfer roller 124 installed in parallel with and opposing the first carrier roller 121 with the photosensitive belt 110 interposed therebetween. The recording sheet 126 is supplied between the transfer roller 124 and a pressing roller 125 installed in parallel with and opposing the transfer roller 124 at a predetermined interval. The toner image transferred on the recording sheet 126 is fixed by separate fixation means (not shown), thereby obtaining a desired image.

However, the transfer roller 124 and the pressing roller 125 are spaced apart from the first carrier roller 121. At the time of transferring the toner image to the recording sheet, since the transfer roller 124 and the pressing roller 125 simultaneously collide against the first carrier roller 121, an instantaneous shock is generated. The vibration due to the shock is transferred to the developer 140 via the photosensitive belt 110, so that the developing solution may not adhere to the electrostatic latent image formed in the photosensitive belt 110.

SUMMARY OF THE INVENTION

To solve the above problem, it is an objective of the present invention to provide a wet electrophotographic printer with an improved structure so that the shock created by the impact of a pressing roller and a transfer roller against a carrier roller can be reduced.

Accordingly, to achieve the above objective, there is provided a wet electrophotographic printer having a plurality of electrostatic latent image forming units for forming an electrostatic latent image on a photosensitive belt on an endless track, a developer for fixing a developing solution on a portion where the electrostatic latent image is formed, a drier for drying the developing solution to form a toner image, a transfer unit for transferring the toner image to a recording sheet, and a carrier unit having a plurality of carrier rollers for rotating the photosensitive belt, wherein the transfer unit comprises: a transfer roller confronting one of the carrier rollers with the photosensitive belt interposed therebetween; a pressing roller confronting the transfer roller with the recording sheet interposed therebetween; and elevating means for elevating the transfer roller and the pressing roller with respect to the transfer roller within a predetermined time interval.

BRIEF DESCRIPTION OF THE DRAWINGS

The above objective and advantages of the present invention will become more apparent by describing in detail a preferred embodiment thereof with reference to the attached drawings in which.

DESCRIPTION OF THE PREFERRED EMBODIMENT(S)

In the present invention, the same elements with those in the conventional art will not be explained herein, only the characteristic structure of the present invention will be described in detail with reference to FIGS. 2 and 3.

Figure 1:
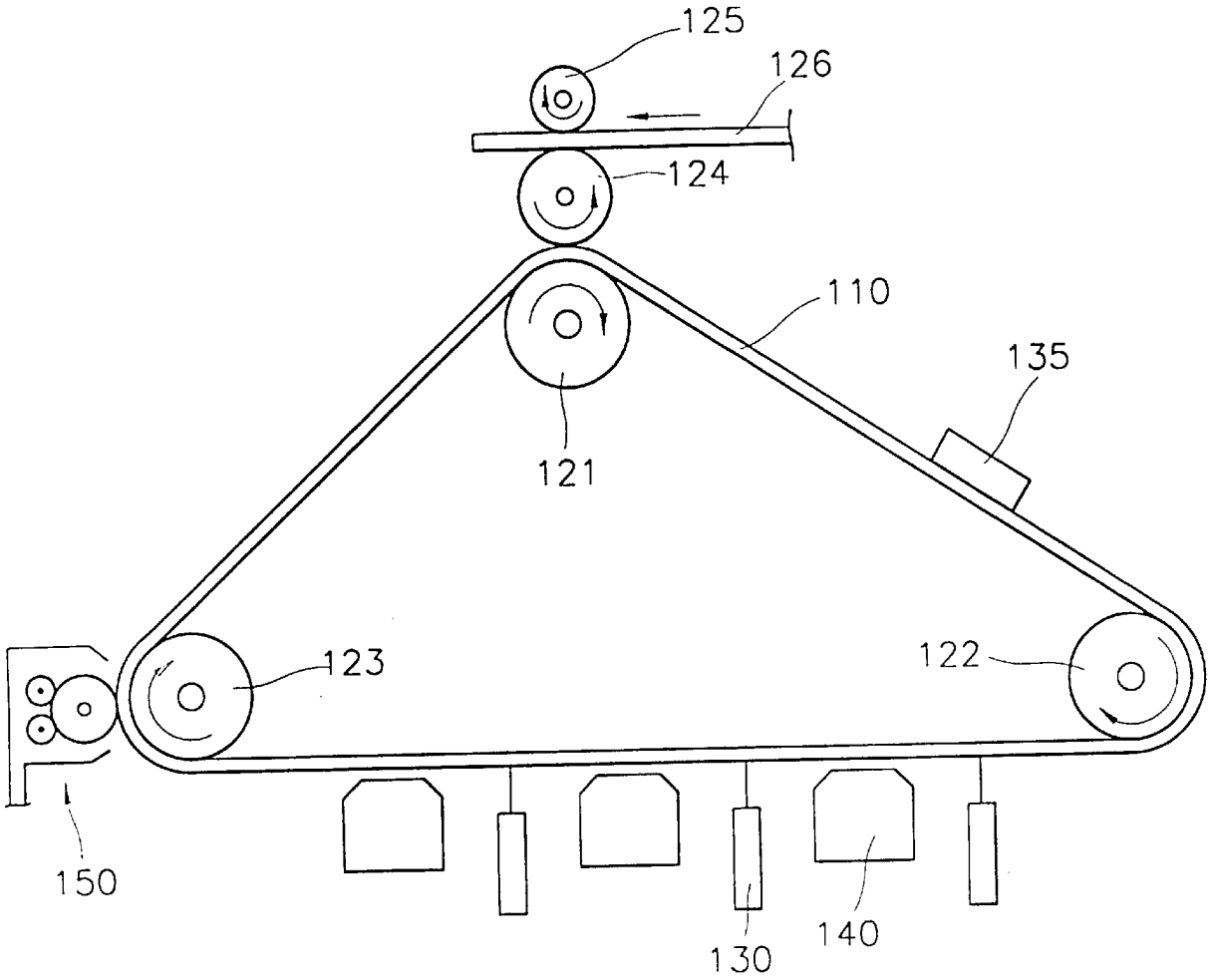
FIG. 1(PRIOR ART)
FIG. 1 is a schematic diagram of a general wet electrophotographic printer.

A photosensitive belt 110 is interposed between a first carrier roller 121 and a transfer roller 124. The transfer roller 124 and pressing roller 125 confront each other so that a recording sheet may be supplied between these two rollers 124 and 125 similar to the configuration described in FIG. 1.

Figure 2:
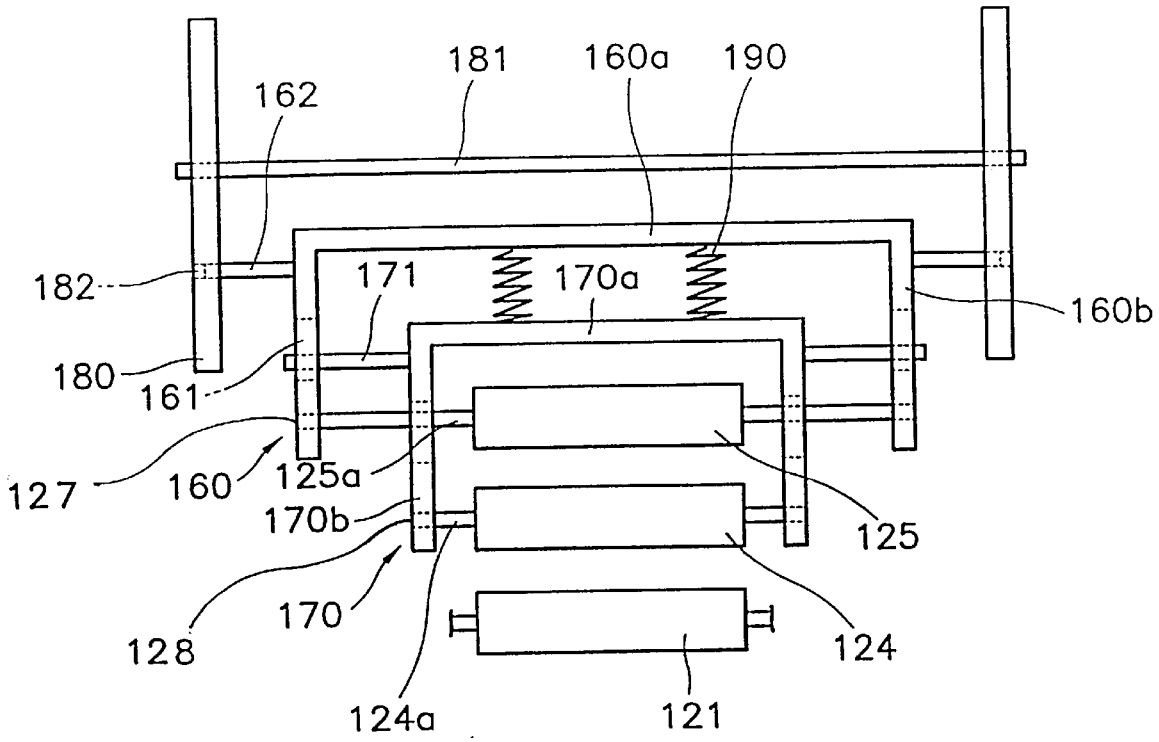
FIGS. 2 and 3 are a side view and a front view, respectively, partly illustrating a wet electrophotographic printer according to the present invention.
Figure 3:
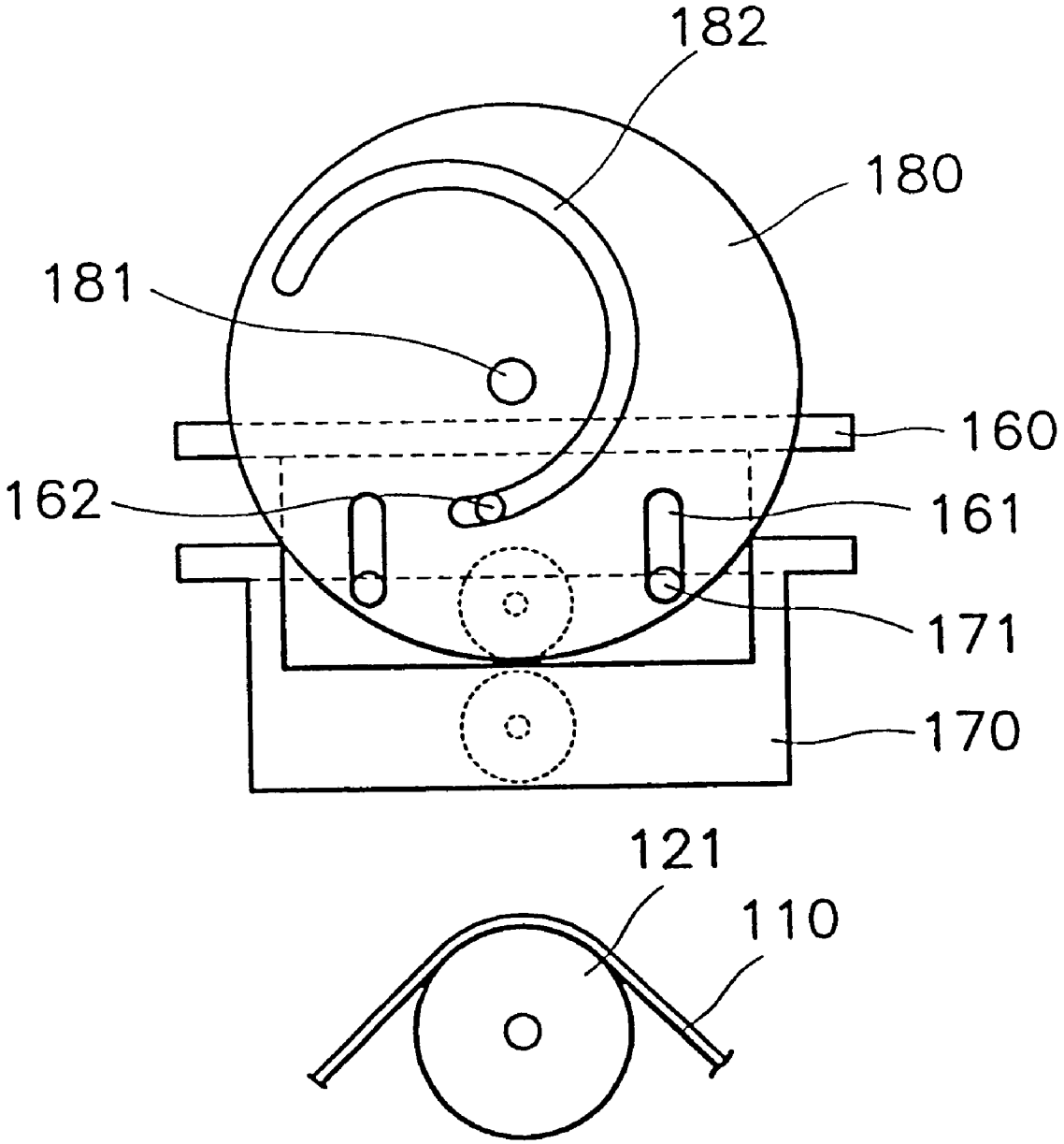

As shown in FIGS. 2 and 3, the pressing roller 125 and transfer roller 124 are respectively connected by two brackets, i.e., a first bracket 160 and a second bracket 170. The first bracket 160 includes a body portion 160*a* and two wall portions 160*b* formed at ends of the body portion 160*a*, respectively, and bent in the downward direction so as to be perpendicular to the body portion 160*a*. The body portion 160*a* is positioned to be parallel with the rotational shaft 125*a* of the pressing roller 125. First projections 162 are formed on the outer portion of the wall portions 160*b* in a direction perpendicular to the wall portions. Slots 161 are formed in the wall portions 160*b*. Recessed grooves 127 into which a rotational shaft 125*a* of the pressing roller 125 is rotatably coupled are formed below the slots 161. A second bracket 170 is provided having second projections 171 coupled with the slots 161 so as to be movable within the slots along the slots' longitudinal direction. A body portion 170*a* of the second bracket 170 positioned in parallel with the body portion 160*a* of the first bracket 160 is provided in the lower portion of the first bracket 160, and perpendicularly bent wall portions 170*b* are formed at both ends of the body 170*a*. Coupling grooves 128 are formed in the vicinity of the second projections 171 on the inner side of the wall portions 170*b* to which a rotational shaft 124*a* of the second transfer roller 124 is rotatably coupled.

A cam shaft 181 is rotatably supported near the upper portion of the first bracket 160. The cam shaft 181 is an annular rod having a circular cam 180 coupled to both ends thereof. The cam 180 has a through hole 182 in the shape of an arc, as shown in FIG. 3. The first projection 162 of the first bracket 160 is coupled to the through hole 182. An elastic member 190, e.g., a tensile spring, is connected to the first and second brackets 160 and 170 so that the mutually coupled state is maintained by a constant elastic force.

According to the wet electrophotographic printer having the aforementioned configuration, the developing solution fixed on the photosensitive belt by the developer is dried by the drier so that the liquid carrier is removed and the toner image with only the toner is left from the electrostatic latent image of the photosensitive belt. The toner image is transferred to the recording sheet by the transfer roller 124 installed in parallel with the first carrier roller 121 with the photosensitive belt interposed therebetween. The recording sheet is supplied between the transfer roller 124 and the pressing roller 125 installed in parallel therewith, and the toner image transferred to the recording sheet is fixed by a separate fixation means (not shown), thereby finally obtaining a predetermined image.

During the above-described process, the transfer roller 124 and the pressing roller 125 are spaced apart from the first carrier roller 121, and they come into contact with the first carrier roller 121 at an opportune timing. First, the second bracket 170 coupled to the transfer roller 124 descends so that the outer peripheral surface of the transfer roller 124 comes into contact with the first carrier roller 121 with the photosensitive belt interposed therebetween. Then, the first bracket 160 connected with the second bracket 170 by the elastic member is pulled in the direction of the transfer roller 124, and the pulled first bracket 160 descends along the slot 161. In this case, the pressing roller 125 descends within a predetermined time interval corresponding to the length of the slot 161 so that it comes into contact with the transfer roller 124. To facilitate ascending and descending the brackets 160 and 170, the cam 180 is operated. If the first projection 162 of the first bracket 160 moves from the central portion of the cam 180 to the peripheral portion thereof via the through hole 182 of a predetermined shape, the first bracket 160 descends. If the first projection 162 moves from the peripheral portion of the cam 180 to the central portion thereof, the first bracket 160 ascends. In such a manner, the elevation of the transfer roller 124 and the pressing roller 125 connected to the respective brackets 160 and 170 is controlled. After the transfer roller 124 comes into contact with the first carrier roller 121, the pressing roller 125 descends to come into contact with the transfer roller 124 within a predetermined time interval. Thus, the shock applied to the transfer roller 124 and the photosensitive belt is minimized, thereby reducing the vibrational effect.

As described above, according to the wet electrophotographic printer of the present invention, a contact pressure can be maintained constantly between a pressing roller and a transfer roller owing to an uniform contact width therebetween.

In other words, since the pressing roller and the transfer roller are connected to each other by an elastic member, a constant pressure is maintained by the elastic force therebetween. Particularly, it is possible to constantly maintain the respective contact widths and pressures between the first carrier roller and the transfer roller and between the transfer roller and the pressing roller.

Also, according to the present invention, the quality of an image transferred on a recording sheet can be improved. In other words, as described above, since the transfer roller and the pressing roller come into contact with the transfer roller with a slight time interval, the shock is reduced so that the shock applied to a developer by the photosensitive belt is weak. Thus, the developing solution fixed on an electrostatic latent image of the photosensitive belt remains distributed evenly, which results in an improved quality of an image transferred on the recording sheet compared to the conventional case.

Although the present invention has been described with respect to the aforementioned embodiments, the invention is not limited thereto. It should be noted that various modifications and alterations may be effected by those skilled in the art within the scope of the invention.

What is claimed is:

1. A wet electrophotographic printer comprising:

at least one electrostatic latent image forming unit for forming an electrostatic latent image on an endless photosensitive belt on a track, a developer for fixing a developing solution on a portion of the photosensitive belt where the electrostatic latent image is formed, a drier for drying the developing solution to form a toner image, a carrier unit having a plurality of carrier rollers rotating the photosensitive belt, and a transfer unit for transferring the toner image to a recording sheet, wherein said transfer unit comprises:

a transfer roller confronting at least one of said carrier rollers with the photosensitive belt interposed therebetween;

a pressing roller confronting said transfer roller for receiving the recording sheet therebetween; and elevating means for elevating said transfer roller and said pressing roller with respect to said carrier roller confronting said transfer roller within a predetermined time interval, said elevating means controlling respective movements of said transfer roller and said pressing roller so that said transfer roller first descends and presses against said carrier roller confronting said transfer roller with the photosensitive belt interposed therebetween while said pressing roller remains separated from said transfer roller, and then said pressing roller descends to press against said transfer roller while said transfer roller remains pressed against said carrier roller.

2. The wet electrophotographic printer according to claim 1, further comprising:

a plurality of electrostatic latent image forming units for forming an electrostatic latent image on the endless photosensitive belt.

3. The wet electrophotographic printer according to claim 1, wherein said elevating means comprises:

a cam shaft;

a cam coupled to an end of said cam shaft, said cam having a hole of a predetermined shape;

a first bracket having a first projection inserted into the hole of said cam and a vertical slot formed substantially perpendicular to the first projection, said first bracket coupled to said pressing roller;

a second bracket having a second projection coupled to the vertical slot of said first bracket, said second bracket coupled to said transfer roller; and an elastic member for elastically connecting said first bracket with said second bracket.

4. The wet electrophotographic printer according to claim 3, wherein said elastic member is a tensile spring.

5. The wet electrophotographic printer according to claim 3, wherein the hole formed in said cam has an arcuate shape.

6. A wet electrophotographic printer comprising:

at least one electrostatic latent image forming unit for forming an electrostatic latent image on an endless photosensitive belt on a track, a developer for fixing a developing solution on a portion of the photosensitive belt where the electrostatic latent image is formed, a drier for drying the developing solution to form a toner image, a carrier unit having a plurality of carrier rollers rotating the photosensitive belt, and a transfer unit for transferring the toner image to a recording sheet, wherein said transfer unit comprises:

a transfer roller confronting at least one of said carrier rollers with the photosensitive belt interposed therebetween;

a pressing roller confronting said transfer roller for receiving the recording sheet therebetween; and elevating mechanism for elevating said transfer roller and said pressing roller with respect to said carrier roller confronting said transfer roller within a predetermined time interval; and wherein said elevating mechanism comprises:

a cam shaft;

a cam coupled to an end of said cam shaft, said cam having a hole of a predetermined shape;

a first bracket having a first projection inserted into the hole of said cam and a vertical slot formed substantially perpendicular to the first projection, said first bracket coupled to said pressing roller;

a second bracket having a second projection coupled to the vertical slot of said first bracket, said second bracket coupled to said transfer roller; and an elastic member for elastically connecting said first bracket with said second bracket.

7. The wet electrophotographic printer according to claim 6, wherein said elastic member is a tensile spring.

8. The wet electrophotographic printer according to claim 6, wherein the hole formed in said cam has an arcuate shape.

9. A wet electrophotographic printer comprising:

at least one electrostatic latent image forming unit for forming an electrostatic latent image on an endless photosensitive belt on a track, a developer for fixing a developing solution on a portion of the photosensitive belt where the electrostatic latent image is formed, a drier for drying the developing solution to form a toner image, a carrier unit having a plurality of carrier rollers rotating the photosensitive belt, and a transfer unit for transferring the toner image to a recording sheet, wherein said transfer unit comprises:

a transfer roller confronting at least one of said carrier rollers with the photosensitive belt interposed therebetween;

a pressing roller confronting said transfer roller for receiving the recording sheet therebetween; and elevating mechanism for elevating said transfer roller and said pressing roller with respect to said carrier roller confronting said transfer roller within a predetermined time interval; and wherein said elevating mechanism comprises:

a cam shaft;

a plurality of cams coupled to respective ends of said cam shaft, said cams having respective holes of a predetermined shape;

a first bracket having first projections inserted into the respective holes of said cams and vertical slots formed substantially perpendicular to the first projections, said first bracket coupled to said pressing roller;

a second bracket having second projections coupled to the vertical slots of said first bracket, respectively, said second bracket coupled to said transfer roller; and an elastic member for elastically connecting said first bracket with said second bracket.

10. The wet electrophotographic printer according to claim 9, wherein said elastic member is a tensile spring.

11. The wet electrophotographic printer according to claim 9, wherein the hole formed in said cam has an arcuate shape.

12. A transfer unit for transferring a toner image to a recording sheet in a wet electrophotographic printer having at least one electrostatic latent image forming unit for forming an electrostatic latent image on an endless photosensitive belt on a track, and a carrier unit having a plurality of carrier rollers rotating the photosensitive belt, the transfer unit comprising:

a transfer roller confronting at least one of the carrier rollers with the photosensitive belt interposed therebetween;

a pressing roller confronting the transfer roller for receiving the recording sheet therebetween; and elevating means for elevating said transfer roller and said pressing roller with respect to said carrier roller confronting said transfer roller within a predetermined time interval, said elevating means controlling respective movements of said transfer roller and said pressing roller so that said transfer roller first descends and presses against said carrier roller confronting said transfer roller with the photosensitive belt interposed therebetween while said pressing roller remains separated from said transfer roller, and then said pressing roller descends to press against said transfer roller while said transfer roller remains pressed against said carrier roller.

13. The transfer unit according to claim 12, wherein said elevating means comprises:

a cam shaft;

a cam coupled to an end of said cam shaft, said cam having a hole of a predetermined shape;

a first bracket having a first projection inserted into the hole of said cam and a vertical slot formed substantially perpendicular to the first projection, said first bracket coupled to the pressing roller;

a second bracket having a second projection coupled to the vertical slot of said first bracket, said second bracket coupled to the transfer roller; and an elastic member for elastically connecting said first bracket with said second bracket.

14. The transfer unit according to claim 13, wherein said elastic member is a tensile spring.

15. The transfer unit according to claim 13, wherein the hole formed in said cam has an arcuate shape.

16. A transfer unit for transferring a toner image to a recording sheet in a wet electrophotographic printer having at least one electrostatic latent image forming unit for forming an electrostatic latent image on an endless photosensitive belt on a track, and a carrier unit having a plurality of carrier rollers rotating the photosensitive belt, the transfer unit comprising:

a transfer roller confronting at least one of the carrier rollers with the photosensitive belt interposed therebetween;

a pressing roller confronting the transfer roller for receiving the recording sheet therebetween; and elevating mechanism for elevating said transfer roller and said pressing roller with respect to said carrier roller confronting said transfer roller within a predetermined time interval; and wherein said elevating mechanism comprises:

a cam shaft;

a cam coupled to an end of said cam shaft, said cam having a hole of a predetermined shape;

a first bracket having a first projection inserted into the hole of said cam and a vertical slot formed substantially perpendicular to the first projection, said first bracket coupled to the pressing roller;

a second bracket having a second projection coupled to the vertical slot of said first bracket, said second bracket coupled to the transfer roller; and an elastic member for elastically connecting said first bracket with said second bracket.

17. The transfer unit according to claim 16, wherein said elastic member is a tensile spring.

18. The transfer unit according to claim 16, wherein the hole formed in said cam has an arcuate shape.

* * * * *